US007507679B2

(12) United States Patent
Taipale et al.

(10) Patent No.: US 7,507,679 B2
(45) Date of Patent: Mar. 24, 2009

(54) PAPER MACHINE FABRIC

(75) Inventors: Seppo Taipale, Juankoski (FI); Terttu Turpeinen, Juankoski (FI); Tania Rautio, Riistavesi (FI); Pekka Kortelainen, Juankoski (FI)

(73) Assignee: Tamfelt OYJ ABP, Tampere (FI)

( * ) Notice: Subject to any disclaimer, the term of this patent is extended or adjusted under 35 U.S.C. 154(b) by 363 days.

(21) Appl. No.: 10/556,155

(22) PCT Filed: Jun. 29, 2004

(86) PCT No.: PCT/FI2004/000402

§ 371 (c)(1),
(2), (4) Date: Nov. 9, 2005

(87) PCT Pub. No.: WO2005/001197

PCT Pub. Date: Jan. 6, 2005

(65) Prior Publication Data

US 2007/0006933 A1 Jan. 11, 2007

(30) Foreign Application Priority Data

Jun. 30, 2003 (FI) ..... 20030983

(51) Int. Cl.
*D03D 15/00* (2006.01)

(52) U.S. Cl. ..... 442/194; 442/208

(58) Field of Classification Search ..... 139/383; 442/194, 208
See application file for complete search history.

(56) References Cited

U.S. PATENT DOCUMENTS

| | | | |
|---|---|---|---|
| 4,041,989 | A | 8/1977 | Johansson et al. |
| 4,361,618 | A | 11/1982 | Dufour et al. |
| 4,501,303 | A | 2/1985 | Österberg |
| 4,605,585 | A | 8/1986 | Johansson |
| 5,152,326 | A | 10/1992 | Vöhringer |
| 5,826,627 | A | 10/1998 | Seabrook et al. |
| 5,967,195 | A | 10/1999 | Ward |

FOREIGN PATENT DOCUMENTS

| | | |
|---|---|---|
| EP | 1 365 066 A1 | 5/2003 |
| FI | B 110131 | 11/2002 |
| WO | WO 01/66856 A1 | 9/2001 |

*Primary Examiner*—Lynda Salvatore
(74) *Attorney, Agent, or Firm*—Oliff & Berridge, PLC

(57) ABSTRACT

A paper machine fabric comprising at least two machine direction yarn systems, which are bound together by means of a binding yarn system. The layer of the machine side is formed of a warp system and a binding yarn system. The binding yarn system comprises a binding yarn, binding yarns or a pair of binding yarns. The binding yarn, the binding yarns or the pair of binding yarns is/are bound to more than one bottom warps at the point where the binding yarn binds the top and bottom warps together.

12 Claims, 3 Drawing Sheets

PAPER MACHINE FABRIC

Figure 1A:
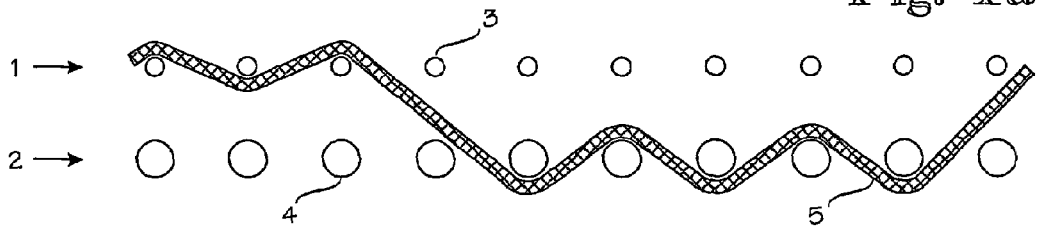

The invention relates to a paper machine fabric comprising at least two machine direction yarn systems. The yarn systems are bound together by means of a binding yarn, binding yarns or a pair of binding yarns.

The basic structure and most properties of paper are mainly determined in the forming section of a paper machine. In paper manufacture, paper pulp is injected from a head box to a paper machine fabric, which pulp typically contains approximately 99% of water, the rest being fibres and possible fillers and additives. In the forming section, most of the water contained in the pulp is removed through the paper machine fabric. One property of a paper web is dry content. The dry content after the forming section refers to the proportion of fibres and fillers in the total basis weight. The dry content is expressed as per cents. For example, the weight of a sample is 500 g and the weight of a dried sample is 100 g, in which case the sample has contained 400 g of water, and thus the dry content is 20%. The aim is that after the forming section the dry content will be as high as possible, because it is more energy-efficient to remove water in the forming section than in the pressing and drying section. Owing to high dry content, the runnability of the paper machine is improved and the number of breaks is reduced. The life time of press felts also gets longer owing to smaller amounts of water. High dry content after the forming section is usually achieved with thin fabrics. The running speeds of paper machines have increased and will increase further in the future, and therefore properties required of paper machine fabrics, such as water removal capacity, stability, clean running and non-splashing, will increase in significance.

In the field, double layer paper machine fabric structures, i.e. double layer forming fabrics, are known. These structures comprise one warp system and two weft systems. The technology of a double layer paper machine fabric is described in U.S. Pat. No. 4,041,989, for example. Usually, the highest dry content has been achieved with such double layer forming fabrics, because they are, owing to the one-warp system, thin. In the case of printing papers, in particular, the warp yarns of double layer forming fabrics are relatively thin. In double layer forming fabrics, the warps are quite adjacent or even slightly overlapping, whereby the amount of cross-direction yarn remains low and there will not be sufficiently many support points for the paper fibres. This results marking and low retention, for instance. Retention refers to the ratio of paper fibres and fillers remaining on the forming fabric to the amount of fed matter in per cents. For example, if all paper fibres and fillers remain on the paper machine fabric, the retention is 100%, and if half of the paper fibres and fillers remain on the paper machine fabric, the retention is 50%.

In double layer forming fabrics, the one-warp system causes low diagonal stability for the paper machine fabric. High diagonal stability means that the cross machine direction and machine direction yarns are well locked to each other at the crossing points and the forming fabric is stable.

In the field, also such paper machine fabrics are known in which the binding yarns binding the paper side layer and the machine side layer together also participate in forming the paper side layer. Such structures are called SSB structures. The technology of SSB structures are described in U.S. Pat. Nos. 4,501,303, 5,967,195 and 5,826,627, for example. In these structures, good diagonal stability is achieved owing to two warp systems, but on the other hand, due to the bottom wefts, the structure becomes thick and the dry content of the paper is lowered.

An object of the invention is to provide such a paper machine fabric by means of which the drawbacks of the prior art can be eliminated. This has been achieved with the paper machine fabric according to the invention. The paper machine fabric comprises at least two machine direction yarn systems. The yarn systems are bound together by means of a binding yarn, binding yarns or pairs of binding yarns. The invention is characterized in that the machine side layer is formed only of bottom warps of the machine side warp system and of binding yarns of the binding yarn system.

An advantage of the structure according to the invention is its low calliper, which contributes to obtaining good dry content in the forming section. The paper machine fabric can be made thin, because the structure does not utilize conventional bottom warps, but the machine side is formed of a warp system and a binding yarn system.

Splashing may occur in the paper machine at the point where the top forming fabric turns to the return cycle. In the worst case, the splashes cause deterioration of the paper web quality. An advantage of a thin structure is the small void volume, which in a paper machine means that the forming fabric carries only a low amount of water and there is less splashing. Since there are no bottom wefts in the structure, machine direction warp paths are formed on the machine side in the structure. Between these warp paths, there remain nearly uninterrupted water removal channels. With such a machine side structure, the water removal effect of the vacuum of the paper machine can be efficiently transmitted to the paper web, and good dry content is achieved. A thin structure is also beneficial in the edge trimming of the paper web. It is easier for the edge trim squirt to push the fibres through a thin fabric, whereby the edge trimming is more likely to succeed and breaks are reduced.

The structure according to the invention is flexible in the machine direction, which facilitates efficient functioning of loadable blades in newer former structures, whereby water removal is made more efficient and paper formation is improved. Paper formation refers here to small-scale variation in the basis weight of paper. When the variation in the basis weight is great, the formation is poor, and when the variation in the basis weight is small, the formation is good.

In a paper machine, the water removal elements are positioned in the cross-machine direction, in other words they are parallel with the weft yarn systems of the paper machine fabric presently used in the forming section. With present paper machine fabrics, the bottom wefts collide with the water removal elements, and bottom weft displacement may occur in the paper machine fabric. In the structure according to the invention, it is mainly the bottom warps of the paper machine fabric that are in contact with the water removal elements, whereby there are no collisions and the load of the paper machine is reduced.

In the structure according to the invention, there is an open machine side, which means that there will be a large number of cross machine direction yarns on the paper side of the structure, and still, the air permeability of the paper machine fabric is sufficiently open. It is easy to keep such a structure clean, and good fibre support is provided for the paper fibre. Thus, the retention of the paper is improved and the marking is decreased. The double warp system and the large number of crossing points on the paper side make the paper machine fabric stable and give good diagonal stability to it.

The paper machine fabric according to the invention comprises at least two machine direction yarn systems, for instance a top warp system and a bottom warp system. In addition, the structure always comprises a binding yarn system which binds the warp systems together. The structure according to the invention does not utilize conventional bottom wefts, but the machine side is formed of a warp system and a binding yarn system. In some structures according to the invention, a top weft system is additionally used. The binding yarn system may contain a binding yarn, binding yarns or a pair of binding yarns. A binding yarn or binding yarns are always bound to more than one bottom warp. In a structure according to the invention, one binding yarn and one top weft function as the weft yarns of the paper side. In this structure, the paper side is formed in such a way that the binding yarn is bound to top warps, and the top weft is arranged to replenish on the paper side the yarn path formed by the abovementioned binding yarn at the points where said binding yarn is interwoven to bottom warps on the machine side.

In a second structure of the invention, there are only binding yarns as the weft yarns of the paper side. The binding yarns are arranged in such a way that two binding yarns woven side by side form a continuous weft path on the paper side.

A third binding yarn structure according to the invention, in turn, comprises two binding yarns woven side by side, which form a continuous weft path and, at the same time, a pair of binding yarns on the paper side. In addition, one or more top wefts are woven between these pairs of binding yarns.

One structure according to the invention utilizes a binding yarn solution similar to the one used in FI patent publication 110131. The structure of the publication comprises a substitute yarn provided with a binding yarn woven on both sides thereof, and the substitute yarn is arranged to replenish the two yarn paths formed by the abovementioned two binding yarns at points where the abovementioned two binding yarns are interwoven with the machine side.

Figure 1B:
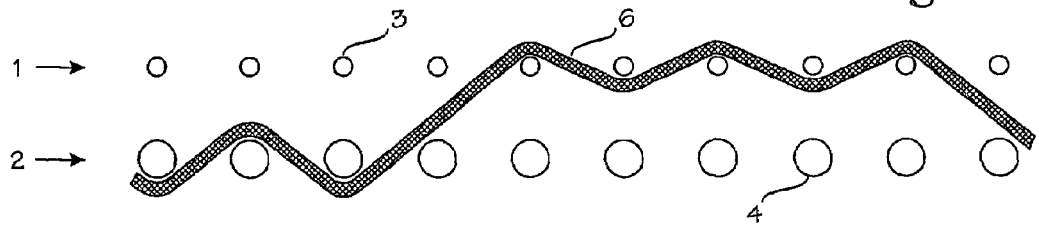
Figure 2A:
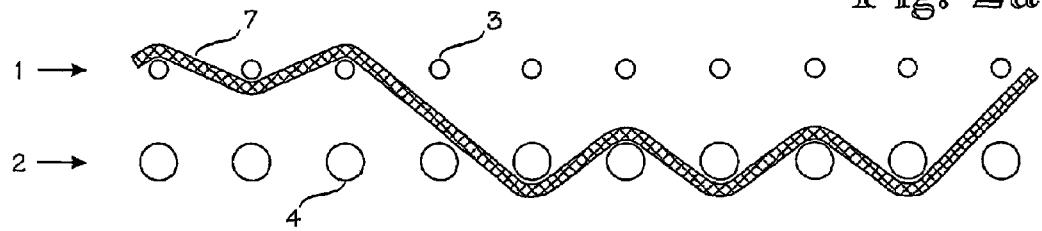
Figure 2B:
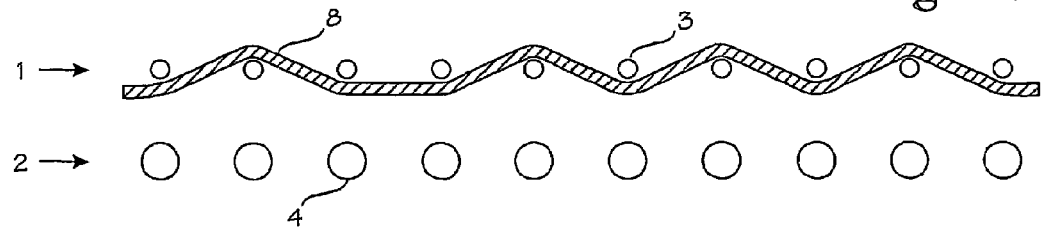

The invention will now be explained in closer detail with reference to the embodiments shown in the attached drawings, whereby FIGS. 1*a* and 1*b* show cross-sectional views of a paper machine fabric according to the invention;

FIGS. 2*a* and 2*b* show cross-sectional views of a second paper machine fabric according to the invention;

FIGS. 3*a* to 3*d* show cross-sectional views of a third paper machine fabric according to the invention;

FIGS. 4*a* to 4*d* show different binding alternatives of binding yarns on the machine side.

FIGS. 1*a* and 1*b* show an embodiment of a paper machine fabric according to the invention, comprising a top warp system and a bottom warp system. Further, the structure comprises a binding yarn system that binds the top warp system and the bottom warp system together.

In FIGS. 1*a* and 1*b,* a layer forming the paper side is indicated with reference numeral 1, a layer forming the machine side being indicated with reference numeral 2. In FIGS. 1*a* and 1*b,* top warps are indicated with reference numeral 3. Bottom warps are indicated by reference numeral 4 in FIGS. 1*a* and 1*b.* The layer 1 forming the paper side and the layer 2 forming the machine side are bound together with a binding yarn system. Binding yarns are indicated with reference numerals 5 and 6. In the weave pattern repeat of this structure, the binding yarns 5 and 6 are arranged in such a way that two binding yarns woven side by side form a continuous weft path on the paper side.

FIG. 1*a* shows binding of the binding yarn 5. The binding yarn 5 is bound on the paper side surface to the top warps 3, forming part of the layer weave, after which the binding yarn 5 moves down to the machine side layer and is bound to the bottom warps 4, forming part of the layer weave and binding, at the same time, the layers of the paper side and machine side together. Binding of the binding yarn 5 to the bottom warps 4 takes place as follows: under one bottom warp, over one, under one, over one, under one. FIG. 1*b* shows, correspondingly, binding of a binding yarn 6. The binding yarn 6 is bound on the paper side surface to top warps 3, forming part of the layer weave, after which the binding yarn 6 moves down to the machine side layer and is bound to the bottom warps 4, forming part of the layer weave and binding, at the same time, the layers of the paper side and machine side together. Binding of the binding yarn 6 to the bottom warps 4 takes place as follows: under one bottom warp, over one, under one. The binding yarns 5 and 6 of FIGS. 1*a* and 1*b* form on the paper side a continuous weft path and, at the same time, a pair of binding yarns. The weave of the weft yarn is a plain weave. In the weave pattern repeat, the pair of binding yarns is repeated according to a selected number of steps.

FIGS. 2*a* and 2*b* show a second embodiment of a paper machine fabric according to the invention, comprising a top warp system and a bottom warp system. Further, the structure comprises a binding yarn system binding the top warp system and bottom warp system together. The structure also comprises a top weft system.

In FIGS. 2*a* and 2*b,* the layer forming the paper side is indicated with reference numeral 1 and the layer forming the machine side is indicated with reference numeral 2. In FIGS. 2*a* and 2*b* top warps are indicated with reference numeral 3. The bottom warps are indicated with reference numeral 4. The layer 1 forming the paper side and the layer 2 forming the machine side are bound together with a binding yarn system. A binding yarn is indicated with reference numeral 7. The structure also comprises a top weft system. A top weft is indicated with reference numeral 8. The weave pattern repeat of this structure comprises alternately a binding yarn 7 and a top weft 8. Thus, the paper side is formed in such a way that the top weft 8 is arranged to supplement on the paper side the yarn path formed by the binding yarn 7 at the points where the binding yarn 7 is bound to the machine side.

FIG. 2*a* shows binding of the binding yarn 7. FIG. 2*b* shows, correspondingly, binding of the top weft 8. The binding yarn 7 is bound to the top warps 3 on the paper side surface, forming part of the layer weave, after which the binding yarn 7, moves down to the machine side layer and is bound to the bottom warps 4, forming part of the layer weave and binding, at the same time, the layers of the paper side and machine side together. Binding of the binding yarn 7 to the bottom warps 4 takes place as follows: under one bottom warp, over one, under one, over one, under one. In the weave pattern repeat, the binding yarn 7 and the top weft 8 are repeated according to a selected number of steps.

FIGS. 3*a* to 3*d* show a third embodiment of a paper machine fabric according to the invention, comprising a top warp system and a bottom warp system. Further, the structure comprises a binding yarn system that binds the top warp system and bottom warp system together. The structure also comprises a top weft system.

Figure 3A:
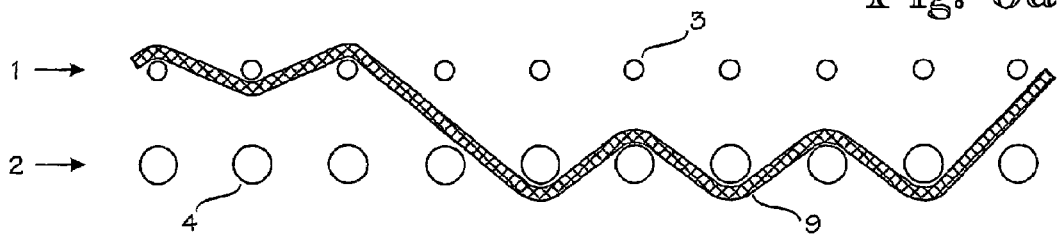
Figure 3B:
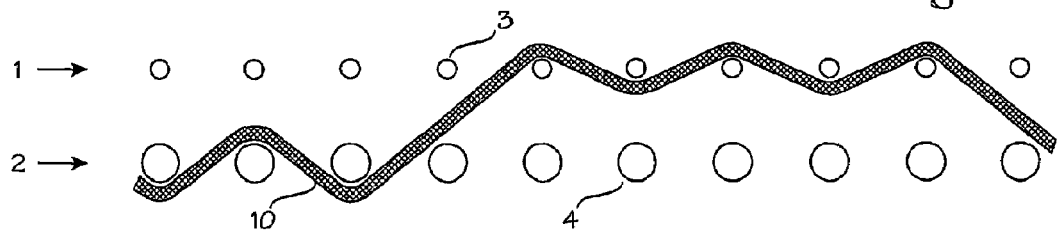
Figure 3C:
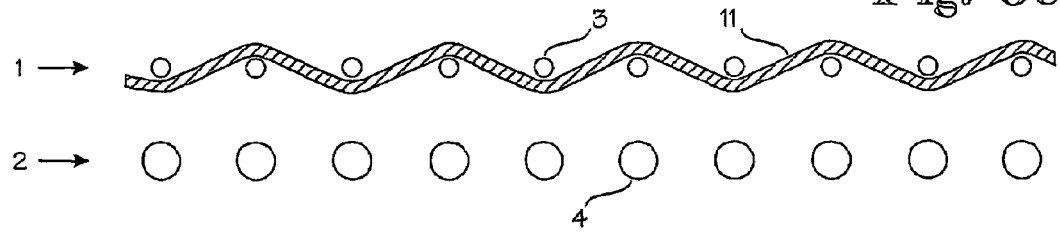

In FIGS. 3*a* to 3*d,* the layer forming the paper side is indicated with reference numeral 1 and the layer forming the machine side is indicated with reference numeral 2. The top warps are indicated with reference numeral 3 in FIGS. 3*a* to 3*d.* The bottom warps are indicated with reference numeral 4 in FIGS. 3*a* and 3*d.* The layer 1 forming the paper side and the layer 2 forming the machine side are bound together with a binding yarn system. In FIGS. 3*a* and 3*b,* binding yarns are indicated with reference numerals 9 and 10. Top wefts of FIGS. 3*c* and 3*b* are indicated with reference numerals 11 and 12. In the weave pattern repeat of this structure, the binding yarns 9 and 10 are arranged in such a way that two binding yarns woven side by side form on the paper side a continuous weft path, and at the same time, a pair of binding yarns. In this embodiment, two top wefts 11 and 12 are also woven between these pairs of binding yarns.

FIG. 3*a* shows binding of the binding yarn 9. The binding yarn 9 is bound on the surface of the paper side to the top warps 3, forming part of the layer weave, after which the binding yarn 9 moves down to the machine side layer and is bound to the bottom warps 4, forming part of the layer weave and binding, at the same time, the layers of the paper side and machine side together. Binding of the binding yarn 9 to the bottom warps 4 takes place as follows: under one bottom warp, over one, under one, over one, under one.

Correspondingly, FIG. 3*b* shows binding of the binding yarn 10. The binding yarn 10 is bound on the surface of the paper side to the top warps 3, forming part of the layer weave, after which the binding yarn 10 moves down to the machine side layer and is bound to the bottom warps 4, forming part of the layer weave and binding, at the same time, the layers of the paper side and machine side together. Binding of the binding yarn 10 to the bottom warps 4 takes place as follows: under one bottom warp, over one, under one. The binding yarns 9 and 10 of FIGS. 3*a* and 3*b* form a continuous weft path on the paper side. A plain weave functions as the weave of the weft path.

Figure 3D:
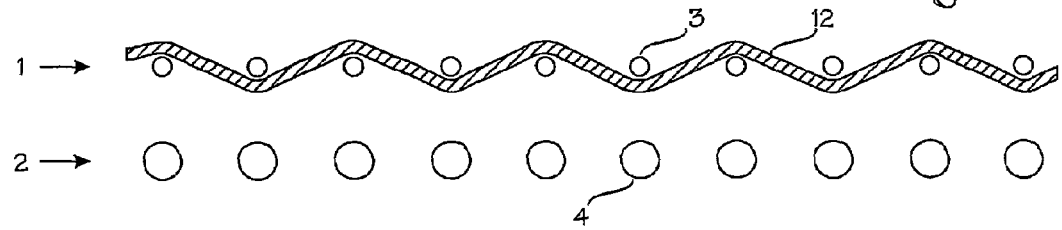

FIG. 3*c* shows binding of the top warp 11 and FIG. 3*d* shows binding of the top weft 12. The top wefts 11 and 12 are bound to form a plain weave, and in this way, they continue the weave formed by a pair of binding yarns on the paper side surface. In the weave pattern repeat, the pair of binding yarns is repeated according to a selected number of steps.

One characterizing feature of the structures of FIGS. 1 to 3 is that the binding yarn, binding yarns or a pair of binding yarns is/are bound to more than one bottom warp at the point where the binding yarn binds the layers of the paper side and machine side together.

The paper machine fabric according to the invention can also be implemented in such a way that the structure comprises several binding yarns and, in addition, 0, 1 or more top wefts and a substitute weft. The substitute weft is provided with a binding yarn woven on both sides thereof, and the substitute weft is arranged to replenish the two yarn paths formed by the abovementioned binding yarns at points where the abovementioned binding yarns are interwoven with the machine side. The substitute weft can be arranged to travel between the layers 1 and 2 when the binding yarn is bound to the top warps on the surface of the paper side.

Figure 4A:
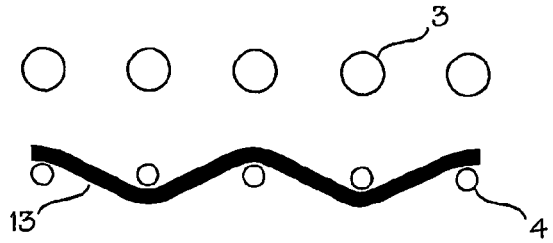
Figure 4B:
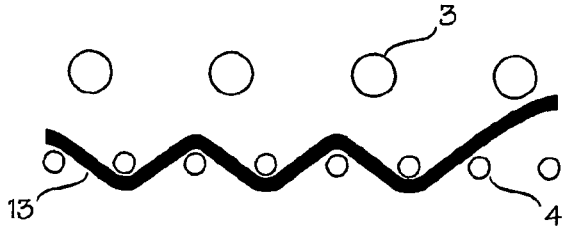
Figure 4C:
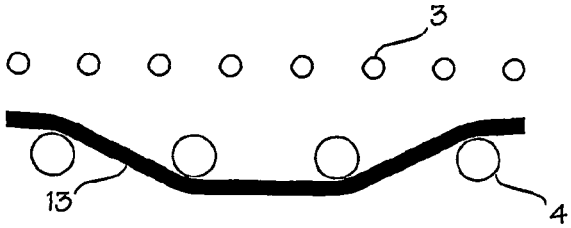
Figure 4D:
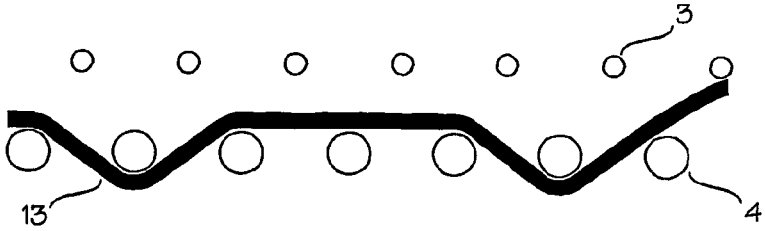

The structures according to FIGS. 1 to 3 are examples of the paper machine fabric according to the invention. One preferred ratio of the top warps to the bottom warps is 1:1. In these structures, the top warps are thinner than the bottom warps and they are aligned. FIGS. 4*a* to 4*d* show examples of different binding alternatives of binding yarns on the machine side, warp ratios and warp thicknesses. In FIGS. 4*a* to 4*d*, the top warps are indicated with reference numeral 3. The bottom warps are indicated with reference numeral 4 in FIGS. 4*a* to 4*d*. Binding yarns are indicated with reference numeral 13. In FIG. 4*a*, binding of the binding yarn 13 to the bottom warps 4 takes place as follows: under one bottom warp, over one, under one. In FIG. 4*a*, the ratio of the top warps to the bottom warps is 1:1 and the top warps are thicker than the bottom warps. In FIG. 4*b*, binding of the binding yarn 13 to the bottom warps 4 takes place as follows: under one bottom warp, over one, under one, over one, under one. In FIG. 4*b*, the ratio of the top warps to the bottom warps is 1:2, and the top warps are thicker than the bottom warps. In FIG. 4*c*, binding of the binding yarn 13 to the bottom warps 4 takes place as follows: under two bottom warps. In FIG. 4*c*, the ratio of the top warps to the bottom warps is 2:1, and the top warps are thinner than the bottom warps. In FIG. 4*d*, binding of the binding yarn 13 to the bottom warps 4 takes place as follows: under one bottom warp, over three, under one. In FIG. 4*d*, the ratio of the top warps to the bottom warps is 1:1, the top warps are thinner than the bottom ones, and the warps are in a staggered position relative to each other.

The following table shows comparison of a preferred structure according to FIGS. 3*a* to 3*d*, a double layer forming fabric and an SSB structure. The paper machine fabrics of the table are suitable to be run at the same position in the paper machine.

| PROPERTY | Structure according to the invention | Double layer forming fabric | Structure bound with a binding yarn pair |
|---|---|---|---|
| Air permeability | 5 000 | 5 000 | 5 100 |
| MD YARNS: Ø/density | | | |
| Top warp (mm/l/cm) | 0.14/31.5 | 0.15/73.8 | 0.14/31.1 |
| Bottom warp (mm/l/cm) | 0.21/31.5 | — | 0.21/31.1 |
| CMD YARNS: Ø/density | | | |
| Top weft (mm/l/cm) | 0.13/31.0 | 0.16/27.7 | 0.13/12.35 |
| Substitute weft (mm/l/cm) | — | — | 0.13/12.35 |
| Binding weft (mm/l/cm) | 0.13/15.5 | — | 0.13/12.35 |
| Bottom weft (mm/l/cm) | — | 0.19/27.7 | 0.22/24.7 |
| MD yarn density (l/cm) | 63.0 | 73.8 | 62.2 |
| CMD yarn density (l/cm) | 46.5 | 55.4 | 61.75 |
| CD yarn density on paper side (l/cm) | 46.5 | 27.7 | 37.05 |
| T count | 110 | 129 | 124 |
| S count | 78.0 | — | 68.15 |
| SP count | 1 465 | — | 1 153 |
| MD bending stiffness (mN) | 283.625 | 57.1 | 315.175 |
| Diagonal stability (displacement percentage with a load of 60 N) | 1.81 | 2.79 | 2.26 |
| Thickness (mm) | 0.52 | 0.59 | 0.75 |
| Warp coverage paper side/machine side | 0.441/0.6615 | 1.107/— | 0.4354/0.6531 |
| Void volume (ml/m$^2$) | 258 | 304 | 403 |

The table shows that the structure according to the invention is significantly thinner than the other ones and that it has also a small void volume. Such a structure does not carry water with it, which means that the rewetting of the paper web is reduced. When functioning as the top forming fabric in the paper machine, such a structure does not splash water to the paper web when turning to the return cycle. Most paper machines have a high vacuum box as the last water removal element before the paper web moves on to the pressing section. The effect of the high vacuum box on the dry content is significant. The thinner the paper machine fabric, the more efficient the functioning of the suction box is. The edge trimming of the paper web is more likely to succeed through a thin structure, because it is easier for the edge trim squirt to push the fibres, whereby breaks are also reduced. The edge trimming is also facilitated by sufficient dry content.

MD bending stiffness indicates the rigidity of the paper machine fabric in the machine direction. The structure according to the invention has lower bending stiffness than the SSB structure. Owing to its more flexible structure, the paper machine fabric according to the invention yields better to the water removal elements, whereby the dry content and formation are improved.

The firmness of the paper machine fabric is measured by diagonal stability. The lower the displacement percentage, the firmer the forming fabric is. The diagonal stability of the structure according to the invention is lowest in the comparison, in other words it is the firmest, which contributes to achieving uniform paper profiles. In addition, a firm paper machine fabric travels straight in the paper machine, and there will be no guiding problems.

Before, the best fibre support and mechanical retention were achieved with SSB structures. The SP count, i.e. the support point number of fibres, indicates the capability of a paper machine fabric to give support to the paper web. The structure according to the invention has an SP count that is 27% greater than in the SSB structure, in other words the structure according to the invention provides excellent fibre support and mechanical retention, which means savings in chemicals.

Newer gap former solutions comprise what are called loadable blades, the task of which is to cause turbulence in the paper web and thus to improve formation. In order for the formation-improving effect of the loadable blades to be optimal, the loadable blade area must be provided with a sufficient amount of water, which can be done with a structure having a dense surface which restrains the intensive removal of initial water, typical of a gap former.

The above embodiments are not, by any means, intended to restrict the invention, but the invention can be modified completely freely within the scope of the claims. Thus, it is obvious that neither the paper machine fabric according to the invention nor its details need necessarily be exactly as shown in the figures, but other types of solutions are also feasible.

Separate layers can be formed very freely, in other words in such a way that the number of yarn systems may vary; what is essential is that there are at least two warp systems, i.e. the top and the bottom warp system.

In the above embodiments, the binding wefts and in some structures the top wefts form for example plain weave on the paper side surface. Also other weaves can be used instead of it, for example satin or twill weaves. The binding of the top wefts may be similar to or different from the binding of the binding yarns. The weaves of the binding yarns may also vary freely within the basic idea of the invention.

All above-described solutions utilize yarns with a round diameter. The yarns or part of the yarns may also be for instance what are called profile yarns, the cross-section of which deviates from round, being for example flat or oval, or of another shape. The yarns may also be hollow, in which case they can flatten in the fabric, which makes the structure even thinner than before. The yarn materials used are typically polyester or polyamide, but also PEN (polyethylene napthalate), PPS (polyphenylene sulfide) or different bicomponent yarns are possible. However, the invention is not, by any means, restricted to the above examples, but it may be applied with different yarns. Fabric properties can be affected by the selection of yarn properties, thus achieving, for instance, a thinner structure than before or an even paper side surface, etc.

The invention claimed is:

1. A paper machine fabric, comprising at least:

a first machine direction yarn system and a second machine direction yarn system, wherein the first machine direction yarn system is formed of top warps and the second machine direction yarn system is formed of bottom warps, said first and second machine direction yarn systems are bound forming a paper side layer and a machine side layer of the paper machine fabric, the first and second machine direction yarn systems being bound together by a binding yarn system that participates in forming the paper side layer, the machine side layer is formed of only bottom warps and binding yarn of the binding yarn system, and the binding yarn system travels on the machine side under at least two non-adjacent bottom warps without ever traveling under two or more adjacent bottom warps at the point where the binding yarn binds the layers of the paper side and machine side together.

2. A paper machine fabric according to claim 1, wherein at least one top weft is woven between the adjacent binding yarns of the binding yarn system.

3. A paper machine fabric according to claim 1, wherein at least one top weft is woven between each adjacent binding yarn of the binding yarn system, and the top weft is arranged to supplement on the paper side the yarn path formed by the binding yarn at the points where the binding yarn is bound to the machine side.

4. A paper machine fabric according to claim 1, wherein the binding yarn system comprises a first binding yarn and a second binding yarn woven side by side that form a continuous weft path on the paper side.

5. A paper machine fabric according to claim 1, wherein the binding yarn system comprises a pair of binding yarns wherein two binding yarns woven side by side, form a continuous weft path on the paper side, and one or more top wefts are woven between the adjacent pairs of binding yarns.

6. A paper machine fabric according to claim 1, further comprising 0, 1 or more top wefts and a substitute weft, wherein a binding yarn is woven on both sides of the substitute weft, and the substitute weft is arranged to replenish the two weft paths formed by said binding yarns at the points where said binding yarns are interwoven to the machine side.

7. A paper machine fabric according to claim 1, wherein the number of machine direction yarns of the layer forming the machine side is greater or smaller than the number of machine direction yarns of the layer forming the paper side.

8. A paper machine fabric according to claim 1, wherein the number of machine direction yarns of the layer forming the machine side is the same as the number of machine direction yarns of the layer forming the paper side.

9. A paper machine fabric according to claim 1, wherein the diameter of the machine direction yarns of the layer forming the machine side is smaller or greater than the diameter of the machine direction yarns of the layer forming the paper side.

10. A paper machine fabric according to claim 1, wherein the diameter of the machine direction yarns of the layer forming the machine side is equal to the diameter of the machine direction yarns of the layer forming the paper side.

11. A paper machine fabric according to claim 1, wherein the cross-section of at least one of the yarns of the paper machine fabric deviates from round.

12. A paper machine fabric according to claim 1, wherein at least one of the yarns of the paper machine fabric is hollow.

* * * * *

UNITED STATES PATENT AND TRADEMARK OFFICE

CERTIFICATE OF CORRECTION

PATENT NO. : 7,507,679 B2
APPLICATION NO. : 10/556155
DATED : March 24, 2009
INVENTOR(S) : Seppo Taipale et al.

It is certified that error appears in the above-identified patent and that said Letters Patent is hereby corrected as shown below:

Title Page, Item (75), change "Seppo Taipale, Juankoski" to -- Seppo Taipale, Siilinjärvi --.

Signed and Sealed this

Thirtieth Day of June, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,507,679 B2
APPLICATION NO. : 10/556155
DATED : March 24, 2009
INVENTOR(S) : Seppo Taipale et al.

It is certified that error appears in the above-identified patent and that said Letters Patent is hereby corrected as shown below:

Title page,
Item (73), please change "Tamfelt OYJ ABP" to --Tamfelt PMC Oy--.

Signed and Sealed this

Fifteenth Day of September, 2009

David J. Kappos

David J. Kappos
*Director of the United States Patent and Trademark Office*